US009603453B2

(12) United States Patent
Hoffman et al.

(10) Patent No.: US 9,603,453 B2
(45) Date of Patent: Mar. 28, 2017

(54) RECLINING CHAIR WITH TILTING ACTION TO PROVIDE HEART-REST POSITION

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 497 days.

(21) Appl. No.: 13/338,398

(22) Filed: Dec. 28, 2011

(65) Prior Publication Data

US 2012/0286557 A1 Nov. 15, 2012

Related U.S. Application Data

(60) Provisional application No. 61/428,063, filed on Dec. 29, 2010.

(51) Int. Cl.
*A47C 1/0355* (2013.01)
*A47C 1/032* (2006.01)

(52) U.S. Cl.
CPC ..... *A47C 1/0355* (2013.01); *A47C 1/03211* (2013.01)

(58) Field of Classification Search
USPC ... 297/83, 84, 85 R, 85 M, 85 L, 88, 89, 75, 297/91, 354.12, 354.13; 244/118.6; 296/174
See application file for complete search history.

(56) References Cited

U.S. PATENT DOCUMENTS 2,714,922 A * 8/1955 McKibban et al. ..... 297/83
2,804,910 A * 9/1957 Bayer ..... 297/84
3,166,352 A * 1/1965 Re ..... 297/75
3,433,527 A * 3/1969 Re ..... 297/85 R
3,476,495 A * 11/1969 Church ..... 297/83
(Continued)

FOREIGN PATENT DOCUMENTS

GB 625003 * 6/1949

*Primary Examiner* — David E Allred
(74) *Attorney, Agent, or Firm* — Myers Bigel, P.A.

(57) ABSTRACT

A reclining health-care chair includes: a base configured to rest on an underlying surface; a frame including a pair of opposed arms; a seat; a backrest; a footrest; a tilting mechanism comprising a plurality of pivotally interconnected links, the tilting mechanism attached to the base and to the seat and configured to control movement of the seat relative to the base; a reclining mechanism comprising a plurality of pivotally interconnected links, the reclining mechanism attached to the backrest, footrest, seat, frame and tilting mechanism to control relative movement of the backrest, footrest, frame and seat relative to the base; and a power actuating unit attached to the seat and to the tilting mechanism. The chair is movable between (a) an upright position, in which the footrest is retracted beneath the seat, the seat defines an angle $\alpha$ relative to the underlying surface, and the backrest defines an angle $\epsilon$ relative to the underlying surface, and (b) a fully reclined position, in which the footrest is extended in front of the seat, the seat defines an angle $\gamma$ relative to the underlying surface that is greater than the angle $\alpha$, the backrest defines an angle $\delta$ relative to the underlying surface that is less than the angle $\epsilon$, and the footrest is positioned such that an occupant's feet are higher than the occupant's heart.

17 Claims, 13 Drawing Sheets

(56) References Cited

U.S. PATENT DOCUMENTS

| | | | | |
|---|---|---|---|---|
| 3,493,264 | A * | 2/1970 | Re | 297/84 |
| 3,572,823 | A * | 3/1971 | Hampton | 297/85 R |
| 3,845,945 | A * | 11/1974 | Lawley et al. | 5/602 |
| 3,934,927 | A * | 1/1976 | Zur | 297/69 |
| 3,934,929 | A * | 1/1976 | Rabinowitz | 297/75 |
| 4,061,397 | A * | 12/1977 | Lewis | 297/330 |
| 4,099,776 | A * | 7/1978 | Crum et al. | 297/329 |
| 4,153,292 | A * | 5/1979 | White et al. | 297/83 |
| 4,212,494 | A | 7/1980 | Dabney | |
| 4,291,913 | A * | 9/1981 | Kowalski | 297/89 |
| 4,660,883 | A * | 4/1987 | Kowalski | 297/85 R |
| 4,674,794 | A * | 6/1987 | Pine | 297/85 M |
| 4,740,031 | A * | 4/1988 | Rogers, Jr. | 297/85 L |
| 4,815,788 | A * | 3/1989 | May | 297/68 |
| 4,852,939 | A * | 8/1989 | Krauska | 297/71 |
| 4,878,710 | A * | 11/1989 | Tacker | 297/68 |
| 4,949,408 | A | 8/1990 | Trkla | |
| 5,015,035 | A * | 5/1991 | Stoeckl et al. | 297/344.17 |
| 5,165,753 | A * | 11/1992 | Henderson | 297/326 |
| 5,309,583 | A * | 5/1994 | White et al. | 4/667 |
| 5,312,153 | A * | 5/1994 | Lin | 297/89 |
| 5,348,367 | A * | 9/1994 | Mizelle | 297/83 |
| 5,419,611 | A * | 5/1995 | Cook | 297/85 L |
| 5,628,546 | A * | 5/1997 | Boetzkes | 297/316 |
| 5,704,686 | A | 1/1998 | May | |
| 5,775,775 | A * | 7/1998 | Hoffman | 297/316 |
| 5,865,457 | A | 2/1999 | Knabusch et al. | |
| 5,868,461 | A | 2/1999 | Brotherston | |
| 5,931,535 | A * | 8/1999 | Sweet | 297/354.13 |
| 5,971,482 | A * | 10/1999 | Goertzen et al. | 297/329 |
| 5,992,930 | A * | 11/1999 | LaPointe et al. | 297/68 |
| 5,992,931 | A * | 11/1999 | LaPointe et al. | 297/85 M |
| 5,992,934 | A * | 11/1999 | Gehrig et al. | 297/316 |
| 6,003,891 | A * | 12/1999 | Broadhead | 280/304.1 |
| 6,120,095 | A | 9/2000 | Rogers | |
| 6,142,558 | A * | 11/2000 | May | 297/75 |
| 6,145,924 | A * | 11/2000 | Mero et al. | 297/68 |
| 6,154,896 | A * | 12/2000 | Houston et al. | 4/667 |
| 6,154,899 | A | 12/2000 | Brooke et al. | |
| 6,237,172 | B1 * | 5/2001 | Morgan, Sr. | 5/618 |
| 6,325,455 | B1 * | 12/2001 | Chung | 297/327 |
| 6,412,870 | B1 * | 7/2002 | Higgins et al. | 297/342 |
| 6,439,636 | B1 * | 8/2002 | Kuo | 296/65.09 |
| 6,527,340 | B1 * | 3/2003 | Finch et al. | 297/330 |
| 6,659,556 | B2 * | 12/2003 | Pellerin | 297/330 |
| 6,672,668 | B1 * | 1/2004 | Boruta et al. | 297/354.12 |
| 6,840,575 | B2 * | 1/2005 | Hesse | 297/85 M |
| 7,114,770 | B2 | 10/2006 | Murphy | |
| 7,163,263 | B1 * | 1/2007 | Kurrasch et al. | 297/217.3 |
| 7,311,359 | B2 * | 12/2007 | Smith | 297/354.12 |
| 7,600,817 | B2 * | 10/2009 | Kramer et al. | 297/362.13 |
| 7,669,921 | B2 * | 3/2010 | Hoffman et al. | 297/61 |
| 7,673,933 | B2 * | 3/2010 | Lawson | 297/69 |
| 7,722,114 | B2 * | 5/2010 | Smith | 297/68 |
| 7,731,276 | B2 * | 6/2010 | Hoffman et al. | 297/85 R |
| 7,762,625 | B2 * | 7/2010 | Hoffman et al. | 297/85 L |
| 7,823,966 | B2 * | 11/2010 | Buchholz | 297/89 |
| 7,997,644 | B2 * | 8/2011 | Hoffman et al. | 297/85 M |
| 8,360,515 | B2 * | 1/2013 | Crum | 297/85 R |
| 2001/0035668 | A1 * | 11/2001 | Gaffney et al. | 297/85 |
| 2003/0025366 | A1 * | 2/2003 | Barreiro, Jr. | 297/217.3 |
| 2004/0004383 | A1 * | 1/2004 | Laurent | 297/354.13 |
| 2004/0012231 | A1 * | 1/2004 | Hesse | 297/85 |
| 2004/0036336 | A1 * | 2/2004 | Veneruso | 297/354.13 |
| 2004/0080191 | A1 * | 4/2004 | Bartlett | 297/85 |
| 2005/0104420 | A1 * | 5/2005 | Murphy | 297/85 |
| 2006/0061148 | A1 * | 3/2006 | Pollard et al. | 297/85 |
| 2007/0126267 | A1 * | 6/2007 | Hoffman et al. | 297/84 |
| 2007/0241589 | A1 * | 10/2007 | LaPointe | 297/85 |
| 2008/0012396 | A1 * | 1/2008 | Hoffman et al. | 297/85 |
| 2008/0111402 | A1 * | 5/2008 | Crum | 297/85 |
| 2008/0250562 | A1 * | 10/2008 | Tekulve | 5/613 |
| 2008/0252116 | A1 * | 10/2008 | Phillips | 297/217.1 |
| 2009/0096255 | A1 * | 4/2009 | Robertson | 297/85 |
| 2009/0174251 | A1 * | 7/2009 | Lawson et al. | 297/85 R |
| 2009/0243368 | A1 * | 10/2009 | LaPointe | 297/85 R |
| 2010/0072805 | A1 * | 3/2010 | Qiu et al. | 297/85 R |
| 2010/0264702 | A1 * | 10/2010 | Hoffman et al. | 297/86 |
| 2010/0283297 | A1 * | 11/2010 | Crum | 297/84 |
| 2011/0193373 | A1 * | 8/2011 | Lawson et al. | 297/71 |
| 2011/0248530 | A1 * | 10/2011 | Sartisohn | 297/83 |
| 2011/0304193 | A1 * | 12/2011 | Murphy et al. | 297/85 M |
| 2012/0049606 | A1 * | 3/2012 | Lawson et al. | 297/85 M |
| 2012/0104827 | A1 * | 5/2012 | Murphy et al. | 297/85 M |
| 2012/0112518 | A1 * | 5/2012 | Murphy et al. | 297/85 L |
| 2012/0112519 | A1 * | 5/2012 | Murphy et al. | 297/85 M |
| 2012/0146364 | A1 * | 6/2012 | Hoffman et al. | 297/84 |
| 2012/0153704 | A1 * | 6/2012 | Hoffman et al. | 297/85 M |
| 2012/0274103 | A1 * | 11/2012 | Kenttamaa-Squires et al. | 297/129 |
| 2012/0286557 | A1 * | 11/2012 | Hoffman et al. | 297/85 M |
| 2012/0299363 | A1 * | 11/2012 | Crum | 297/85 M |
| 2013/0175847 | A1 * | 7/2013 | Lawson | 297/85 M |

* cited by examiner

RECLINING CHAIR WITH TILTING ACTION TO PROVIDE HEART-REST POSITION

RELATED APPLICATIONS

This application claims priority from U.S. Provisional Patent Application Ser. No. 61/428,063, filed Dec. 29, 2010, the disclosure of which is hereby incorporated herein by reference in its entirety.

FIELD OF THE INVENTION

The present invention is directed to furniture, and more particularly to seating units for the health care industry.

BACKGROUND OF THE INVENTION

The advent of home health care has created a need for furniture that provides functional features for the patient as well as more conventional function for others. For example, chairs exist that are capable of reclining in a number of positions in the same manner as traditional, non-medical recliner chairs while being movable to a "heart-rest" position (also known as the Trendellenburg position). The heart-rest position is one in which the occupant of the chair is postured such that his legs are elevated to a height equal to or above his heart, with the result that blood is encouraged to flow to the heart rather than pooling in the legs. This position is often used to treat shock (particularly during dialysis treatments).

One exemplary chair that combines reclining capability with the capacity to move to the heart-rest position is discussed and illustrated in U.S. Pat. No. 5,348,367 to Mizelle. The Mizelle chair includes a relatively simple six-bar linkage system and can stop in any intermediate position between an upright and a fully reclined position. An attendant can then lift the front of the seat frame of the chair to bring the chair into a "heart-rest" position in which the seat frame, back frame and leg rest assume "the position of a lounge chair that has been tilted approximately 45 degrees." Another exemplary chair, available from Lumex, Inc., utilizes a reclining mechanism from a conventional residential reclining chair. In this chair, the reclining mechanism is configured such that, once the chair is in a fully reclined position (i.e., one in which the backrest and seat have pivoted relative to one another so that the angle therebetween increases), a foot pedal can release the mechanism to continue its reclining motion, with the angle between the backrest and the seat continuing to increase. As a result, the heart-rest position of this chair provides a support surface in which mimics that of a hospital bed. Another exemplary chair, discussed in U.S. Patent Publication No. 20030015893 to Hoffman et al., also utilizes a mechanism from a conventional three-way reclining chair. The chair can move from the fully reclined position to the heart-rest position by pivoting relative to the frame, such that the backrest and seat maintain a similar angle to one another; this pivoting movement is actuated by a foot pedal. A still further exemplary chair with heart-rest position capability is discussed in U.S. Pat. No. 7,114,770 to Hoffman et al.

In view of the foregoing, additional configurations for health care chairs may be desirable.

SUMMARY OF THE INVENTION

As a first aspect, embodiments of the invention are directed to a reclining health-care chair. The chair comprises: a base configured to rest on an underlying surface; a frame including a pair of opposed arms; a seat; a backrest; a footrest; a tilting mechanism comprising a plurality of pivotally interconnected links, the tilting mechanism attached to the base and to the seat and configured to control movement of the seat relative to the base; a reclining mechanism comprising a plurality of pivotally interconnected links, the reclining mechanism attached to the backrest, footrest, seat, frame and tilting mechanism to control relative movement of the backrest, footrest, frame and seat relative to the base; and a power actuating unit attached to the seat and to the tilting mechanism. The chair is movable between (a) an upright position, in which the footrest is retracted beneath the seat, the seat defines an angle $\alpha$ relative to the underlying surface, and the backrest defines an angle $\epsilon$ relative to the underlying surface, and (b) a fully reclined position, in which the footrest is extended in front of the seat, the seat defines an angle $\gamma$ relative to the underlying surface that is greater than the angle $\alpha$, the backrest defines an angle $\delta$ relative to the underlying surface that is less than the angle $\epsilon$, and the footrest is positioned such that an occupant's feet are higher than the occupant's heart.

As a second aspect, embodiments of the invention are directed to a reclining health-care chair, comprising: a base configured to rest on an underlying surface; a frame including a pair of opposed arms; a seat; a backrest; a footrest; a tilting mechanism comprising a plurality of pivotally interconnected links, the tilting mechanism attached to the base and to the seat and configured to control movement of the seat relative to the base; a reclining mechanism comprising a plurality of pivotally interconnected links, the reclining mechanism attached to the backrest, footrest, seat, frame and tilting mechanism to control relative movement of the backrest, footrest, frame and seat relative to the base; and a power actuating unit attached to the seat and to the tilting mechanism. The chair is movable between (a) an upright position, in which the footrest is retracted beneath the seat, the seat defines an angle $\alpha$ relative to the underlying surface, and the backrest defines an angle $\epsilon$ relative to the underlying surface, and (b) a fully reclined position, in which the footrest is extended in front of the seat, the seat defines an angle $\gamma$ relative to the underlying surface that is greater than the angle $\alpha$, the backrest defines an angle $\delta$ relative to the underlying surface that is less than the angle $\epsilon$. An uppermost portion of the seat is between about 1 and 6 inches higher than an uppermost portion of the backrest.

As a third aspect, embodiments of the invention are directed to a reclining health-care chair, comprising: a base configured to rest on an underlying surface; a frame including a pair of opposed arms; a seat; a backrest; a footrest; a tilting mechanism comprising a plurality of pivotally interconnected links, the tilting mechanism attached to the base and to the seat and configured to control movement of the seat relative to the base; a reclining mechanism coupled to the tilting mechanism and comprising a plurality of pivotally interconnected links, the reclining mechanism attached to the backrest, footrest, seat, frame and tilting mechanism to control relative movement of the backrest, footrest, frame and seat relative to the base; and a power actuating unit attached to the seat and to the tilting mechanism. The chair is movable between (a) an upright position, in which the footrest is retracted beneath the seat, the seat defines an angle $\alpha$ relative to the underlying surface, and the backrest defines an angle $\delta$ relative to the underlying surface, and (b) a fully reclined position, in which the footrest is extended in front of the seat, the seat defines an angle $\gamma$ relative to the underlying surface that is greater than the angle $\alpha$, the backrest defines an angle δ relative to the underlying surface that is less than the angle ϵ, and the footrest is positioned such that an occupant's feet are higher than the occupant's heart.

DETAILED DESCRIPTION OF EMBODIMENTS OF THE INVENTION

Figure 1:
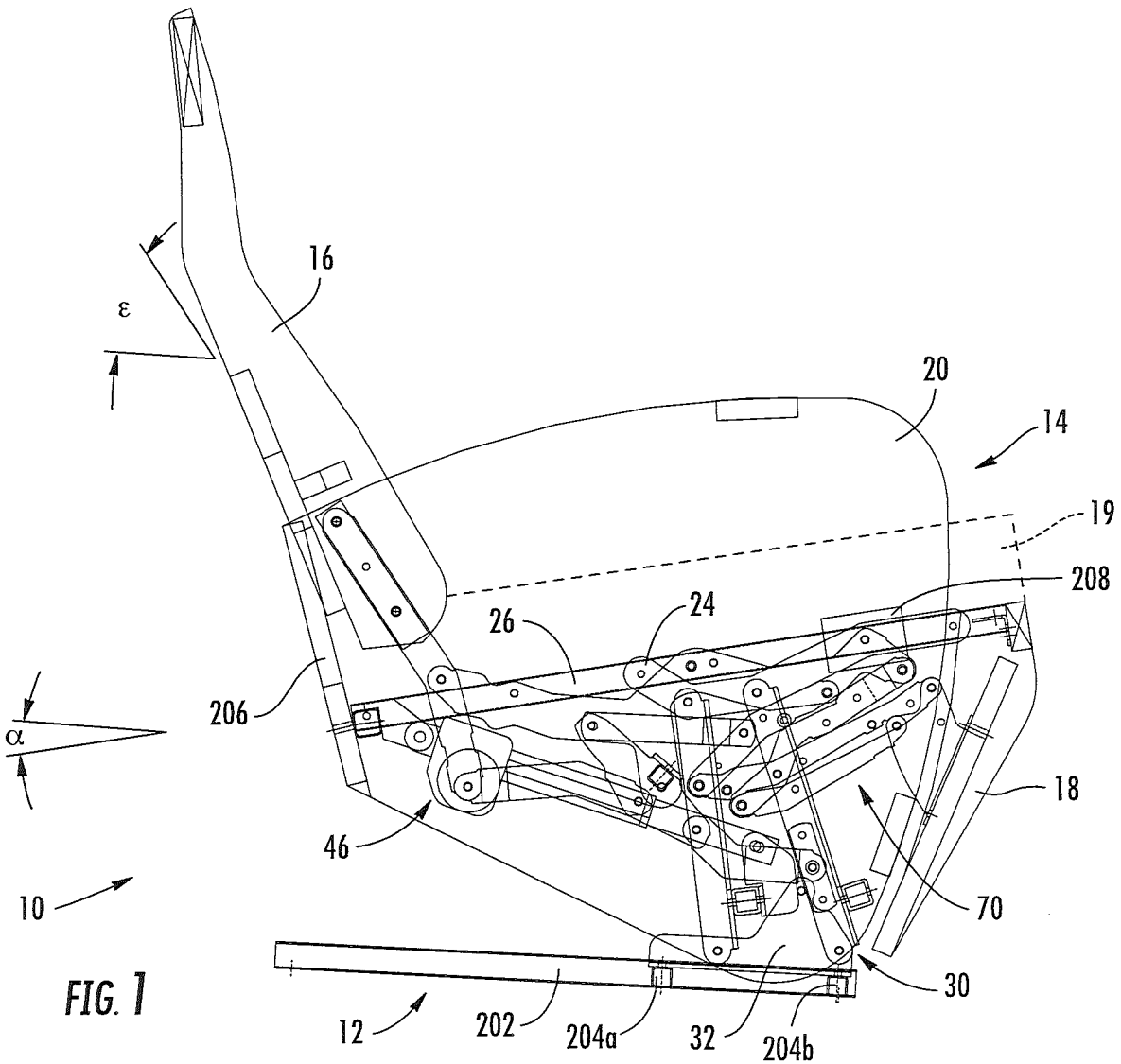
FIG. 1 is a cutaway side view of the reclining chair according to embodiments of the present invention, wherein the chair is shown in an upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 2:
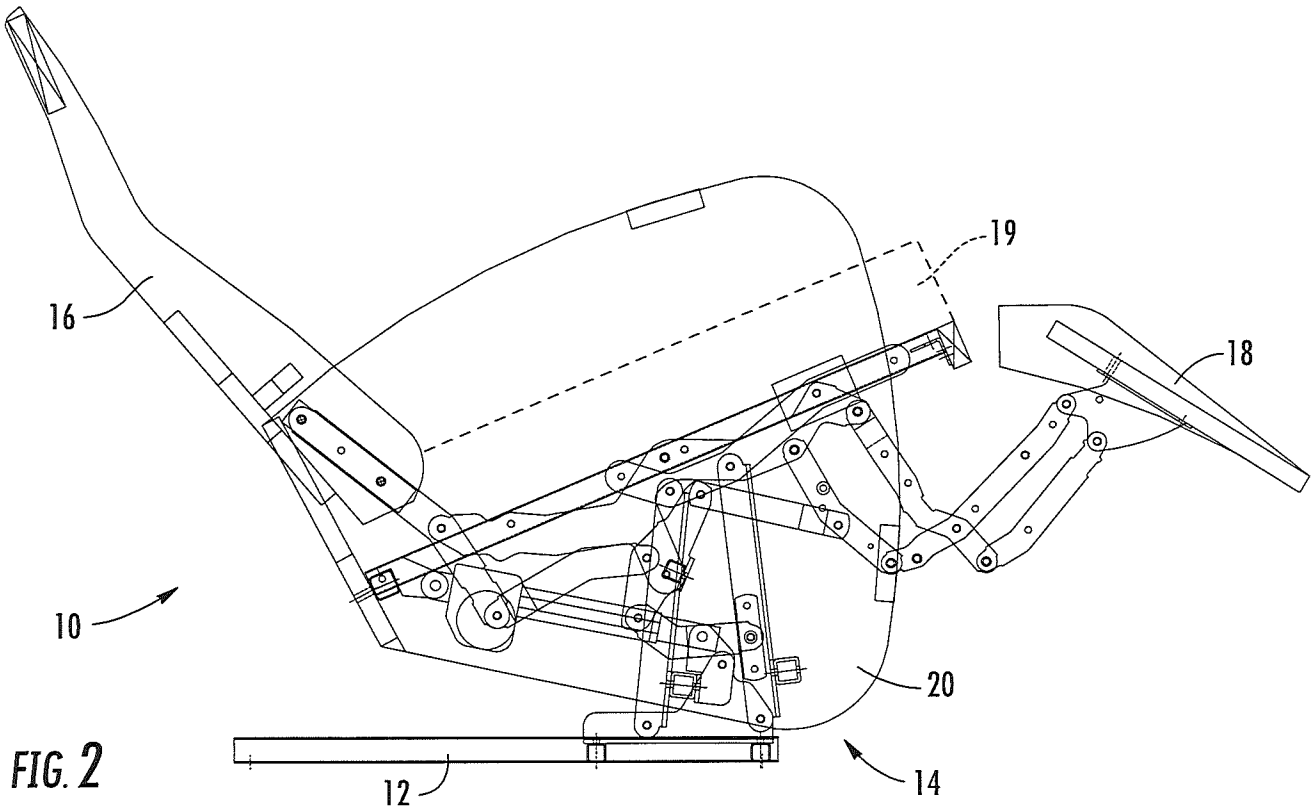
FIG. 2 is a cutaway side view of the chair of FIG. 1 in an intermediate position.
Figure 3:
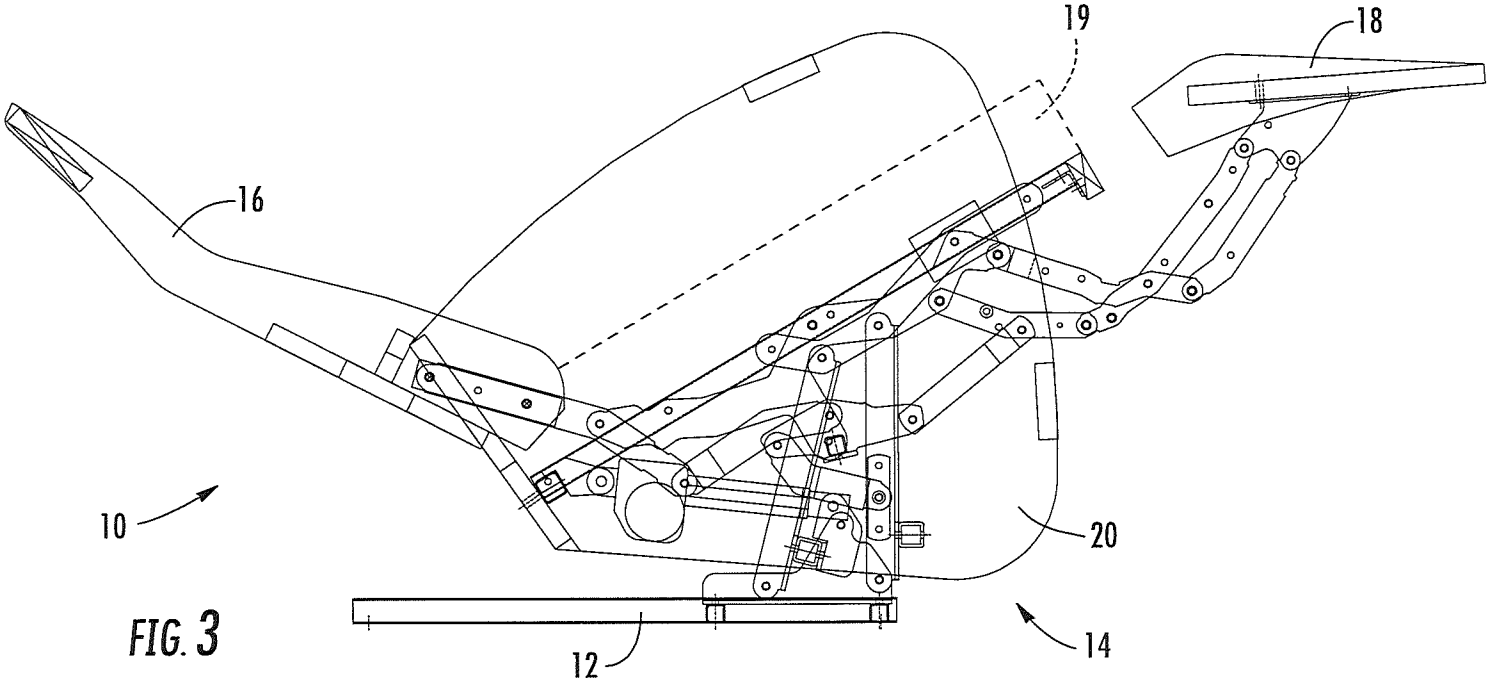
FIG. 3 is a cutaway side view of the chair of FIG. 1 in a fully reclined position.
Figure 4:
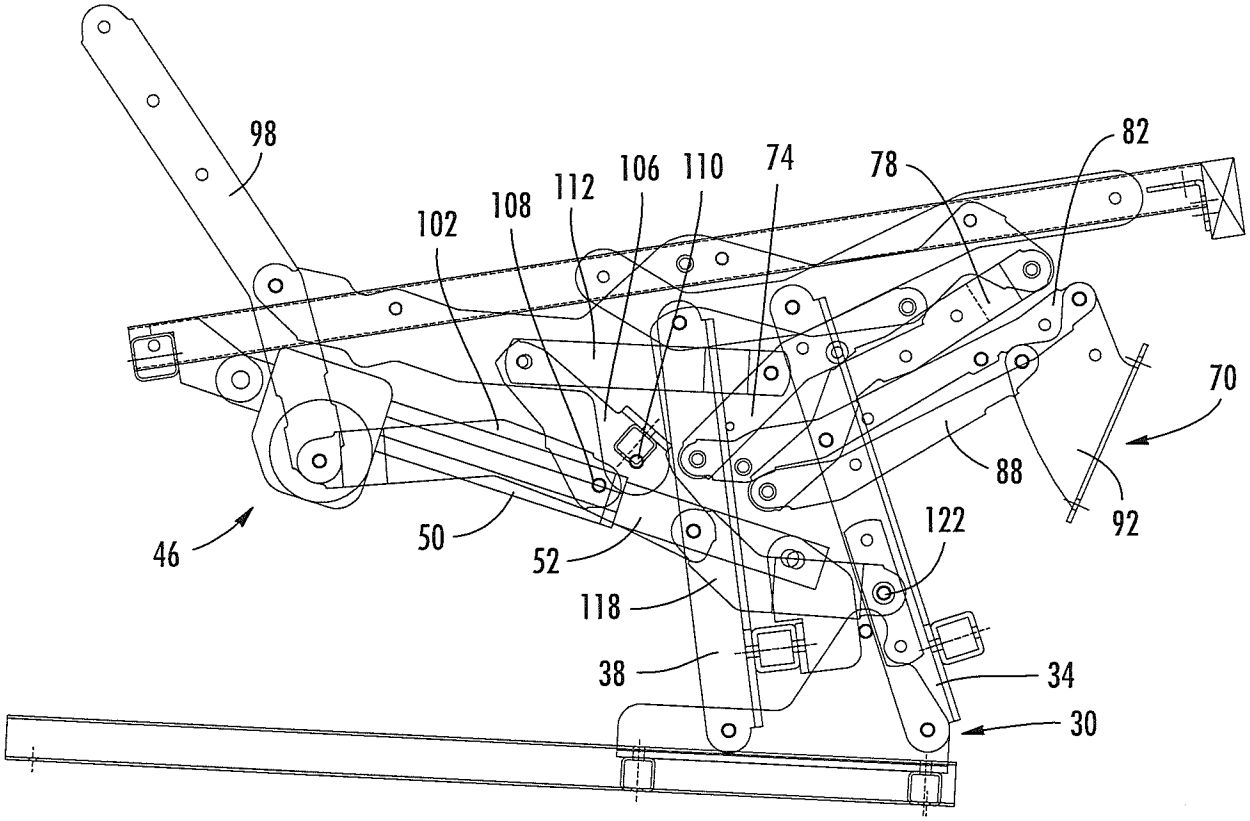
FIG. 4 is a cutaway side view of the reclining and tilt mechanisms of the chair of FIG. 1, wherein the chair is shown in its upright position.
Figure 5:
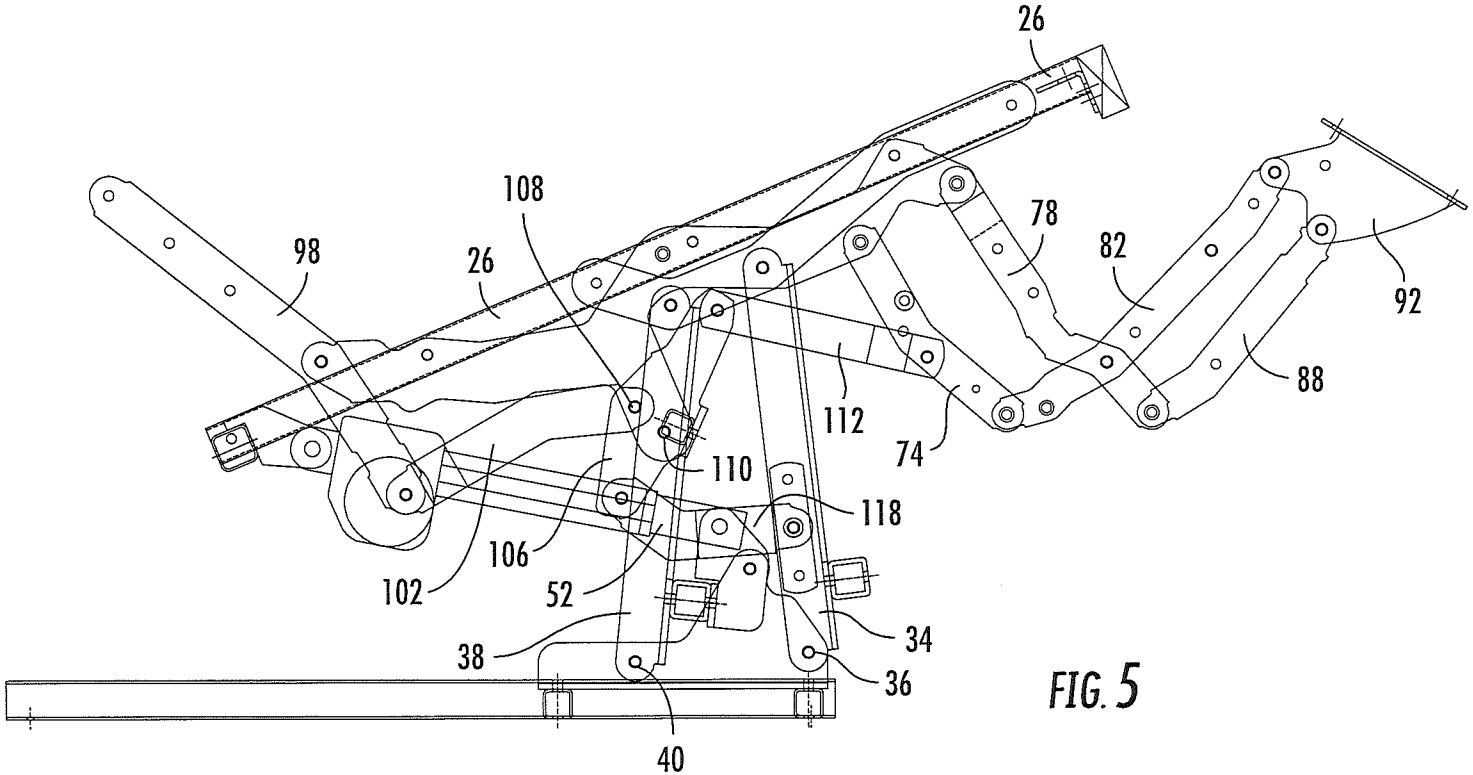
FIG. 5 is a cutaway side view of the reclining and tilt mechanisms of FIG. 4, with the chair in the intermediate position of FIG. 2.
Figure 6:
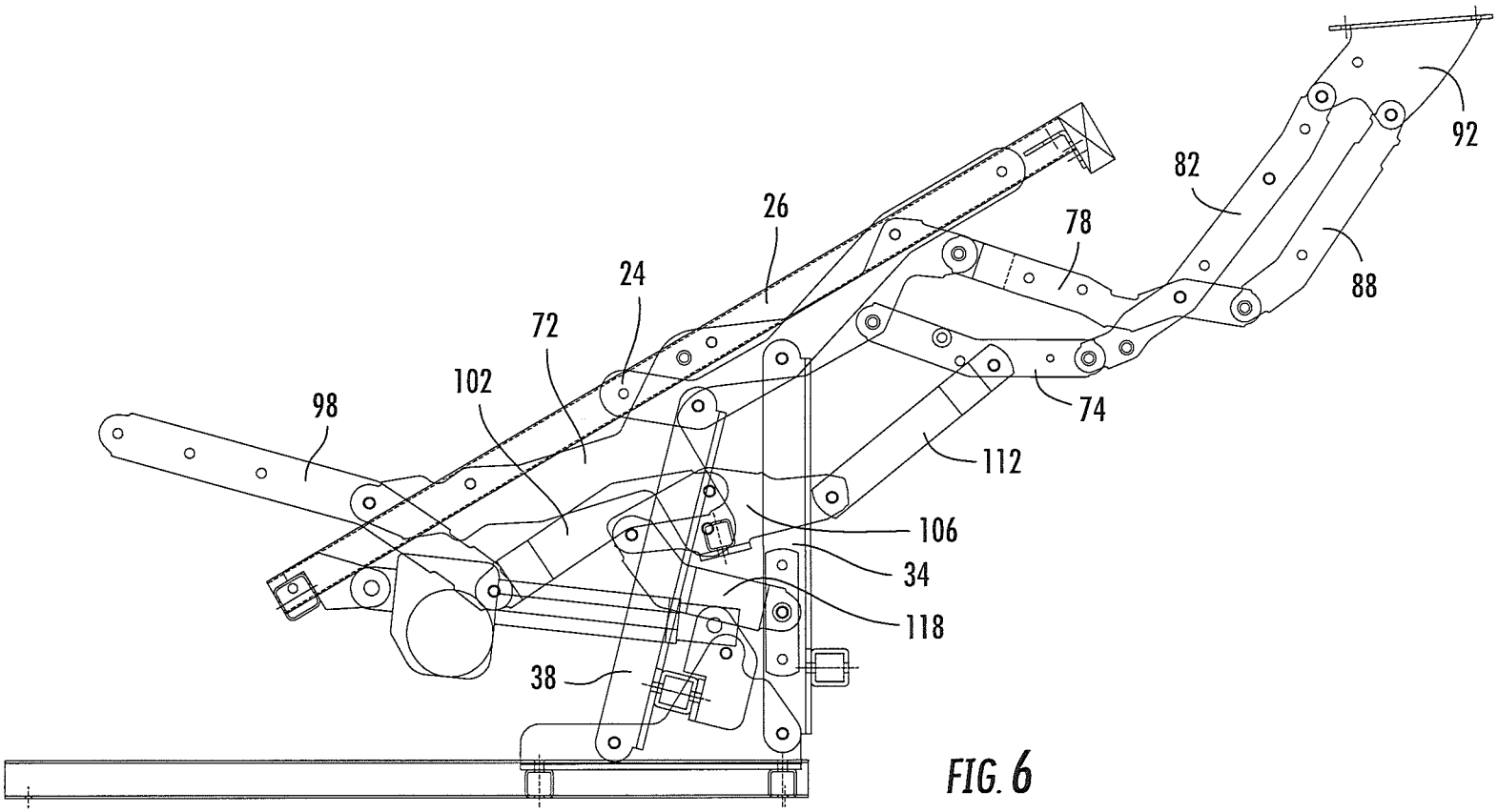
FIG. 6 is a cutaway side view of the reclining and tilt mechanisms of FIG. 4, with the chair in its fully reclined position.

Referring now to the drawings, a chair, designated broadly at 10, is illustrated in FIGS. 1-3. The chair 10 includes a base 12 configured to rest on an underlying surface, a frame 14 that includes two arms 20, a backrest 16, a footrest 18, and a seat 19 having an underlying seat frame 26. These components are moved via a pair of tilt mechanisms 30 and a pair of reclining mechanisms 70 between an upright position (FIG. 1), an intermediate TV position (FIG. 2), and a fully reclined position (FIG. 3). Components of the chair 10 are described below.

Figure 13:
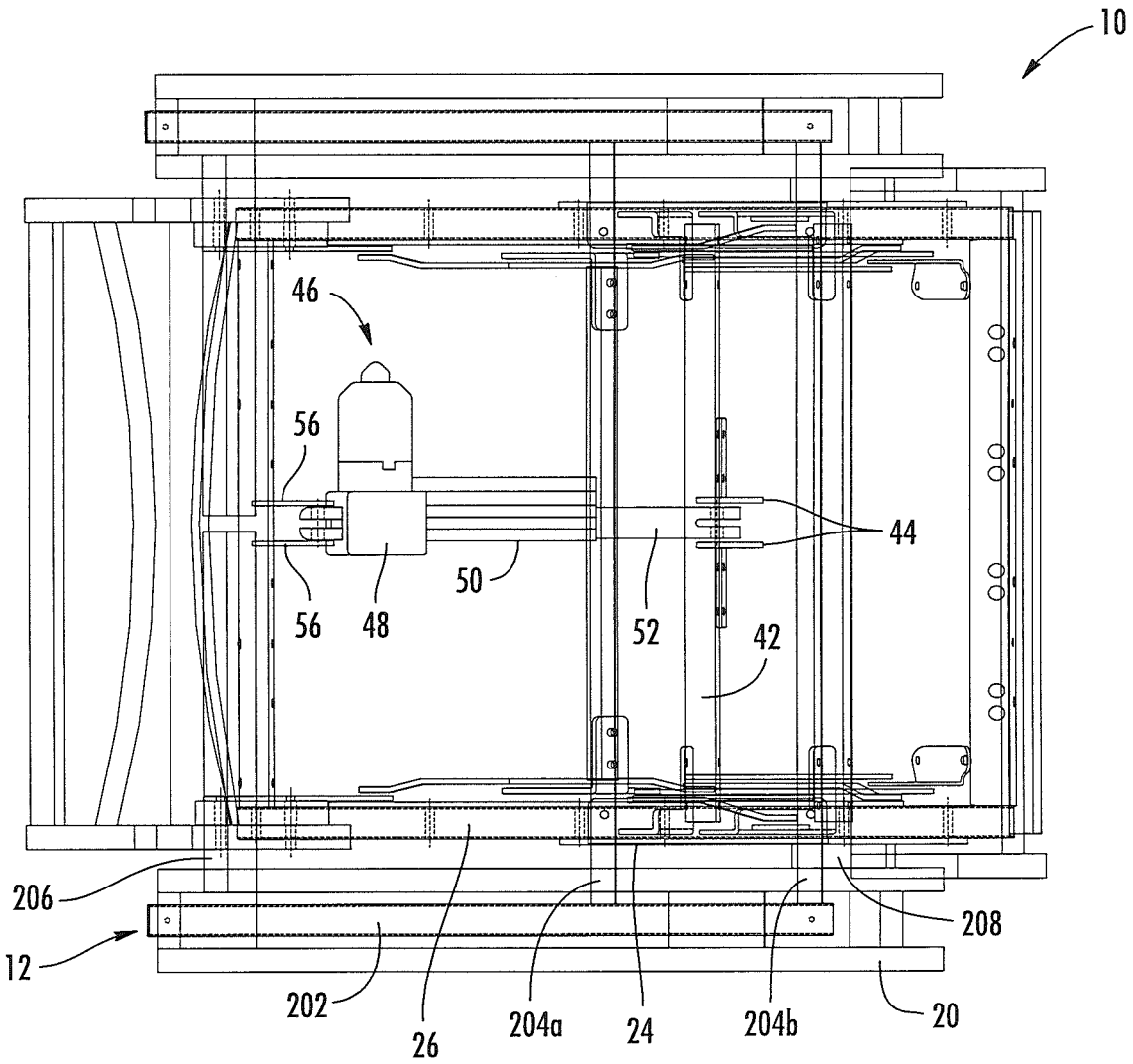
FIG. 13 is a top view of the chair of FIG. 1 in its upright position.

Referring to FIGS. 1 and 13, the base 12 includes two rails 202 that are spanned by cross-members 204*a*, 204*b*. A triangular mounting plate 32 is mounted to the cross-members 204*a*, 204*b* inboard of the rails 202.

Still referring to FIGS. 1 and 13, the arms 20 of the frame 14 are hollow and are spanned by a cross-member 206 fixed to their rear portions. A shim 208 is mounted to the inboard surface of each arm 20. Each shim 208 is mounted to an adapter link 24 that is fixed to the lateral edge of the seat frame 26.

Figure 10:
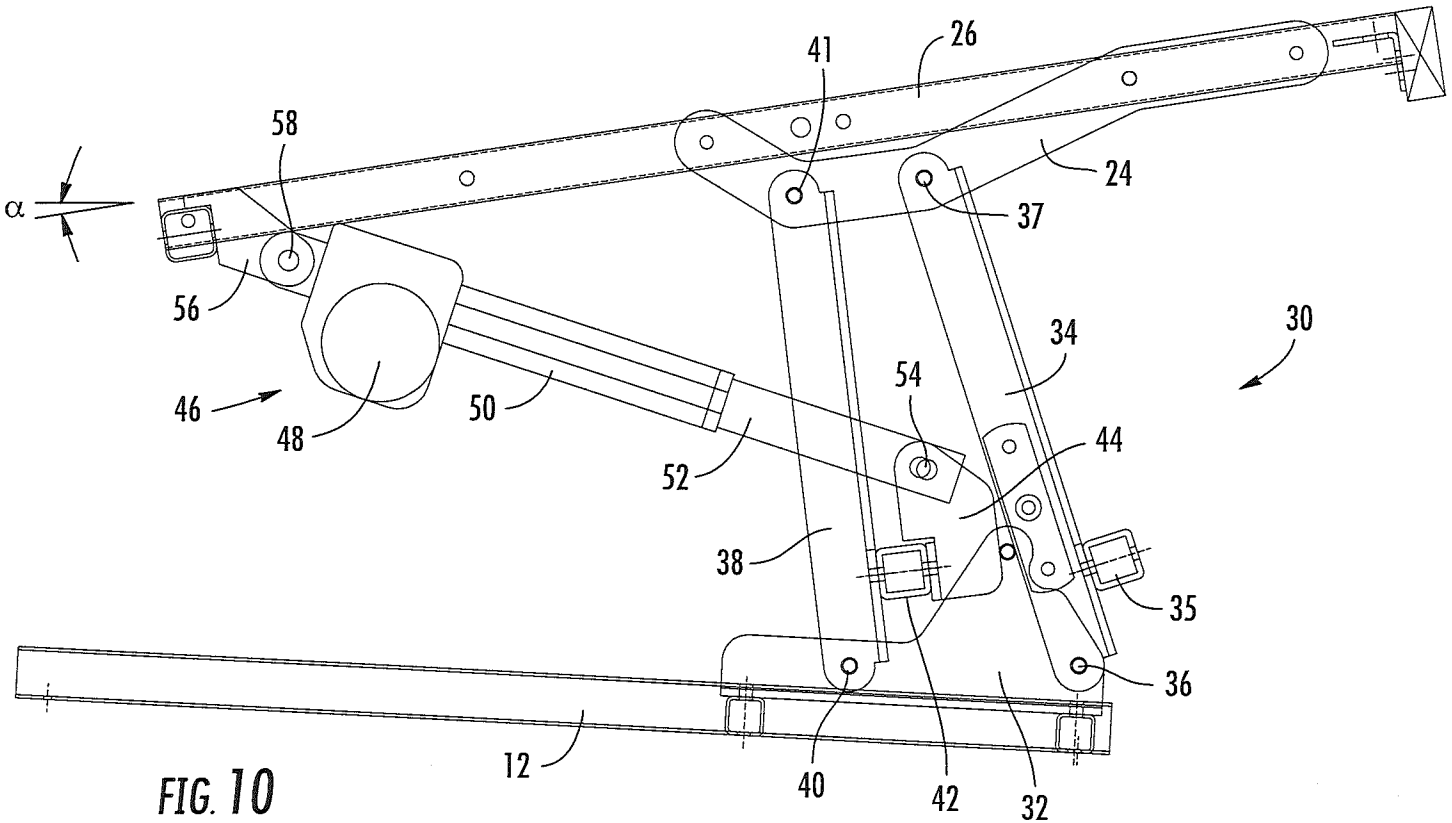
FIG. 10 is a cutaway side view of the tilt mechanism of the chair of FIG. 1, wherein the chair is shown in its upright position.

Referring now to FIG. 10, the tilt mechanisms 30 will be described first in the upright position, with the orientation of its components in the TV and fully reclined positions described subsequently. The tilt mechanisms 30 are mirror images of each other about a vertical plane that bisects the chair 10 between the arms 20; as such, only one tilt mechanism will be described herein, with the understanding that the description is equally applicable to the tilt mechanism 30 mounted on the opposite side of the chair 10.

Referring still to FIG. 10, the tilt mechanism 30 includes and is mounted to the base 12 via the mounting plate 32. A front tilt link 34 is attached to a mounting plate 32 at a pivot 36 and extends upwardly and somewhat rearwardly therefrom. A cross-member 35 extends between the front tilt links 34 of the opposed tilt mechanisms 30. At its upper end, the front tilt link 34 is attached at a pivot 37 to the adapter link 24 that is fixed to the lateral edge of the seat frame 26. The tilt mechanism 30 also includes a rear tilt link 38 that is attached to the mounting plate 32 at a pivot 40. The rear tilt link 38 extends upwardly and slightly rearwardly from the pivot 40 to attach to the adapter link 24 at a pivot 41 that is located rearwardly of the pivot 37. A cross-member 42 extends between the rear tilt links 38 of the tilt mechanisms 30 on opposite sides of the chair 10.

Referring still to FIG. 10 and to FIG. 13, two motor brackets 44 are fixed to the forward surface of the cross-member 42. A power actuating unit 46 (in this embodiment a linear actuator) comprises a motor 48, a sleeve 50 and a retractable rod 52, with the free end of the rod 52 being mounted to the motor bracket 44 at a pivot 54. The motor 48 is attached at a pivot 58 to two seat flanges 56 that depend from the rear edge of the seat frame 26. In the upright position of FIGS. 1, 4, 7, 10 and 13, the rod 52 is in an extended position relative to the sleeve 50. The power actuating unit 46 is electrically connected with an actuator (not shown), such as a toggle switch or the like, that energizes the power unit 46 upon actuation.

In the upright position of FIG. 10, the seat frame 26 has a pitch angle $\alpha$ with the floor (or other surface underlying the base 12) of between about 6 and 12 degrees. The backrest 16 (as defined by the backpost 98, described below) forms an angles of between about 50 and 58 degrees with the floor (see FIG. 1).

Figure 7:
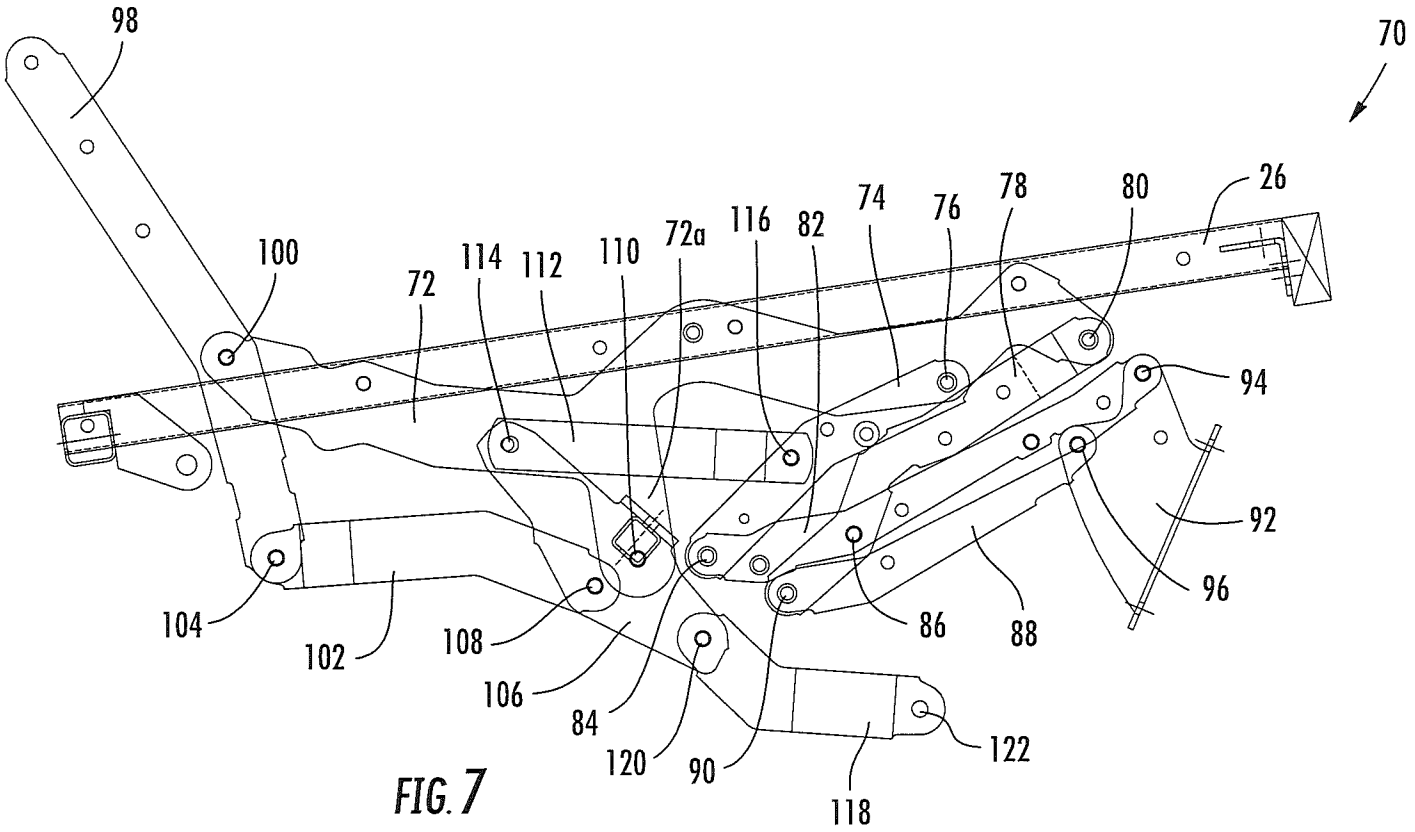
FIG. 7 is a cutaway side view of the reclining mechanism of the chair of FIG. 1, wherein the chair is shown in its upright position.

Referring now to FIG. 7, like the tilt mechanisms 30, the reclining mechanisms 70 are mirror images of each other about the aforementioned bisecting vertical plane, so only one will be described herein. The reclining mechanism 70 will be described first in the upright position of FIG. 7, with its orientation in the TV and fully reclined positions being subsequently described.

Referring still to FIG. 7, the reclining mechanism 70 includes a seat mounting link 72 that is fixed to the inner edge of the rail of the seat frame 26. A rear footrest swing link 74 is attached to the seat mounting link 72 at a pivot 76 and extends rearwardly and downwardly therefrom. Similarly, a front footrest swing link 78 is attached to the seat mounting link 72 at a pivot 80 and extends rearwardly and downwardly therefrom. An upper footrest extension link 82 is attached at one end to the rear footrest swing link 74 at a pivot 84 and to the front footrest swing link 78 at a pivot 86. The upper footrest extension link 82 extends forwardly and upwardly from the pivot 86. A lower footrest extension link 88 is attached to the front footrest swing link 78 at a pivot 90 and extends forwardly and upwardly therefrom. A footrest mounting bracket 92 is attached to the upper footrest extension link 82 at a pivot 94 and to the lower footrest extension link 88 at a pivot 96. In the upright position of FIG. 7, the front surface of the footrest mounting bracket 92 faces forwardly and downwardly, with the footrest 18 positioned below and rearward of a frontmost edge of the seat 19. As can be seen in FIG. 1, the footrest 18 is mounted on the footrest mounting bracket 92. These links comprise a pantographic footrest extension linkage that extends the footrest 18.

Referring again to FIG. 7, a backpost 98 is fixed to the backrest 16 and is attached to the rear end of the seat mounting link 72 at a pivot 100. The lower end of the backpost 98 extends downwardly and somewhat forwardly from the pivot 100. A backrest drawing link 102 is attached at its rear end to the lower end of the backpost 98 at a pivot 104. A transition link 106 is attached to the forward end of the backrest drawing link 102 at a pivot 108 and to a projection 72*a* of the seat mounting link 72 at a pivot 110. A footrest drive link 112 is attached to the upper, rear end of the transition link 106 at a pivot 114 and to the rear footrest swing link 74 at a pivot 116. A connecting link 118 is attached to the lower, forward end of the transition link 106 at a pivot 120 and extends forwardly therefrom to a pivot 122 with the front tilt link 34 (this can be seen in FIG. 4). Thus, the tilting mechanism 30 is coupled to the reclining mechanism 70.

Figure 11:
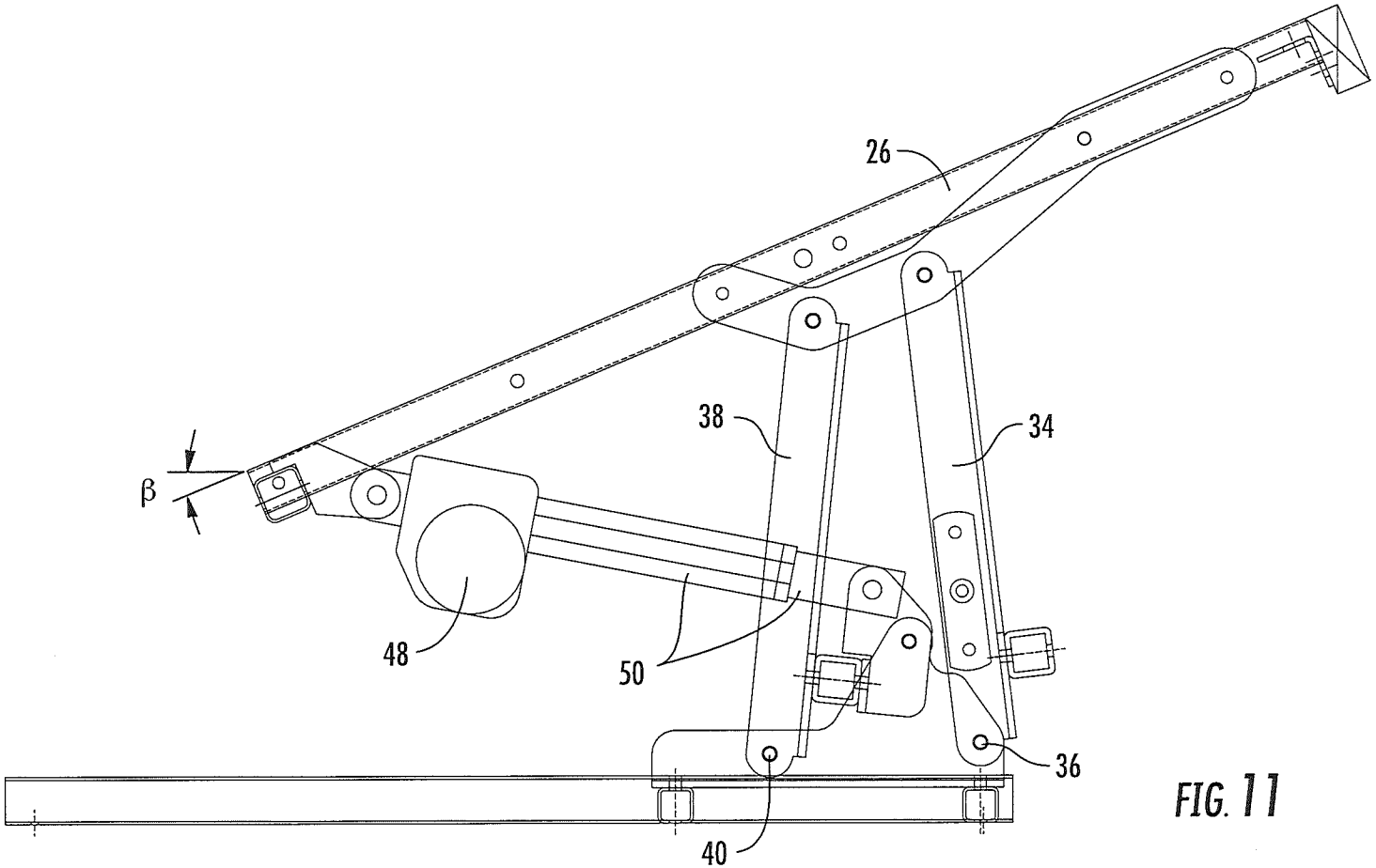
FIG. 11 is a cutaway side view of the tilt mechanism of FIG. 10, with the chair in the intermediate position of FIG. 2.

To move the chair 10 from the upright position of FIGS. 1, 4, 7 and 10 to the intermediate position shown in FIGS. 2, 5, 8 and 11, an occupant of the chair 10 actuates the motor 48 of the power unit 46, thereby causing the rod 52 to begin to retract into the sleeve 50. Retraction of the rod 52 draws the rear end of the seat frame 26 forwardly and downwardly, which in turn forces the rear tilt link 38 and the front tilt link 34 to pivot (clockwise from the vantage point of the figures) about, respectively, the pivots 40, 36. This action forces the forward end of the seat frame 26 upwardly as it moves forward. As can be seen in FIG. 11, in this intermediate position the seat frame 26 (and, in turn, the seat 19) defines an angle $\beta$ with the floor of between about 20 and 25 degrees, which is an angular change of between about 10 and 15 degrees from its orientation in the upright position.

Figure 8:
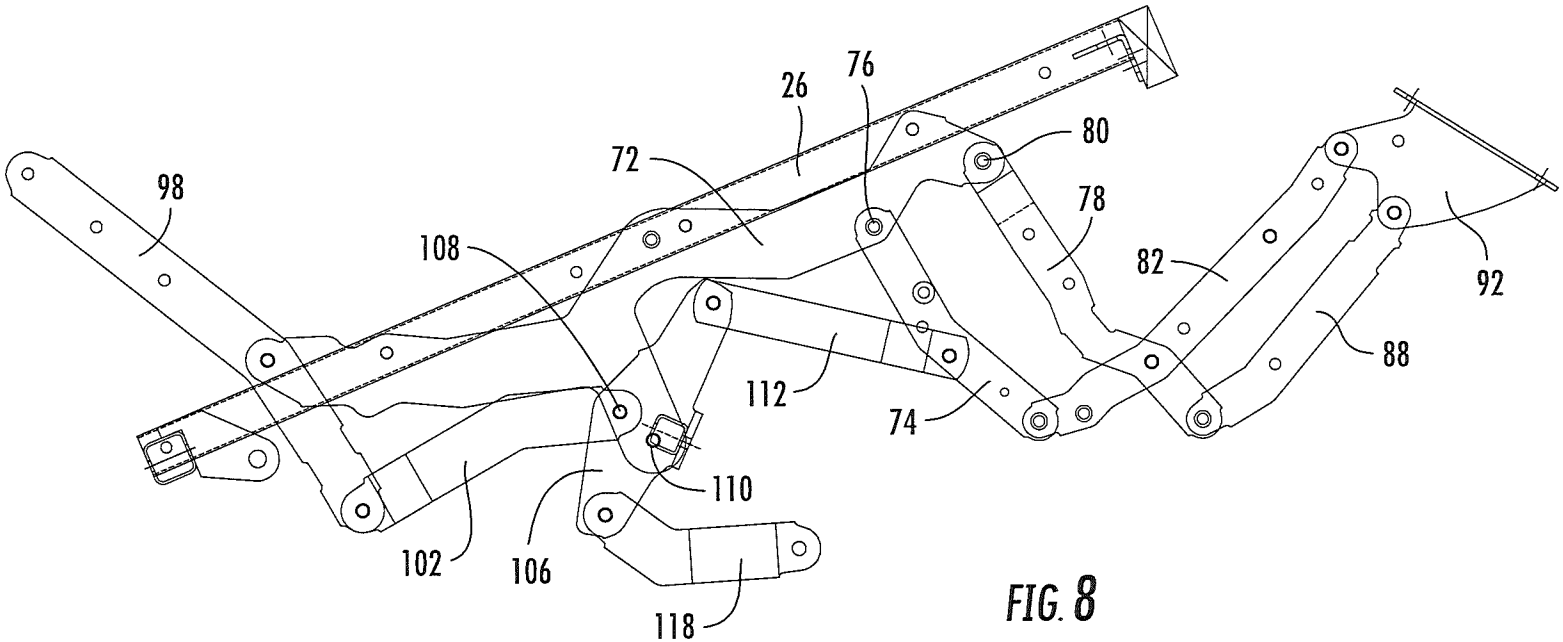
FIG. 8 is a cutaway side view of the reclining mechanism of FIG. 7, with the chair in the intermediate position of FIG. 2.
Figure 9:
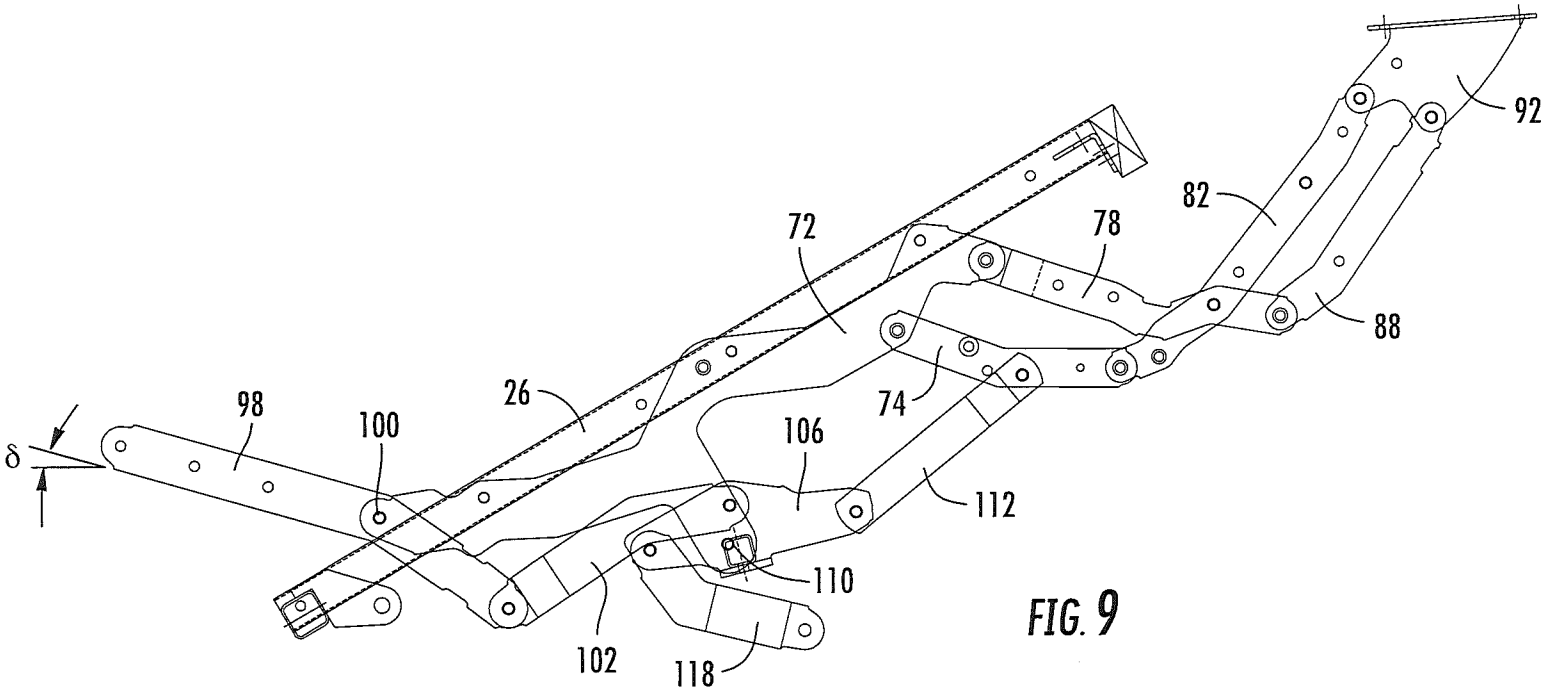
FIG. 9 is a cutaway side view of the reclining mechanism of FIG. 7, with the chair in its fully reclined position.

In addition, the relative movement of the seat frame 26 and the front pivot link 34 causes the reclining mechanism 70 to extend the footrest 18. Referring to FIGS. 7 and 8, as the rear end of the seat frame 26 moves forwardly, it draws the lower end of the backpost 98 forwardly also, which in turn forces the backrest drawing link 102 forwardly. As the front pivot link 34 rotates clockwise about the pivot 36, it draws the connecting link 118 forwardly, but to a lesser degree than the backrest drawing link 102. As both the backrest drawing link 102 and the connecting link 118 are attached to the transition link 106, the difference in their movements causes the transition link 106 to rotate clockwise about the pivot 110. This movement drives the footrest drive link 112 forward, which rotates the rear footrest swing link 74 counterclockwise about the pivot 76. The rotation of the rear footrest swing link 74 forces the upper footrest extension link 82 forwardly and upwardly; this action draws the front footrest swing link 78 counterclockwise about the pivot 80. Rotation of the front footrest swing link 78 drives the lower footrest extension link 88 forwardly and upwardly. Because the lower footrest extension link 88 moves more than does the upper footrest extension link 82, the footrest mounting bracket 92, and in turn the footrest 18 rotates counterclockwise to a generally horizontal disposition (FIG. 8).

Notably, during this portion of the movement of the reclining mechanism 70, the rotation of the transition link 106 about the pivot 110 moves the pivot 108 between the transition link 106 and the backrest drawing link 102 upwardly relative to the seat frame 26, but the pivot 108 does not experience substantial forward or rearward movement relative to the seat frame 26. Consequently, the backrest 18 stays in generally the same orientation relative to the seat 19 during this portion of the reclining motion (the angular change is typically no more than about 4 degrees).

Figure 12:
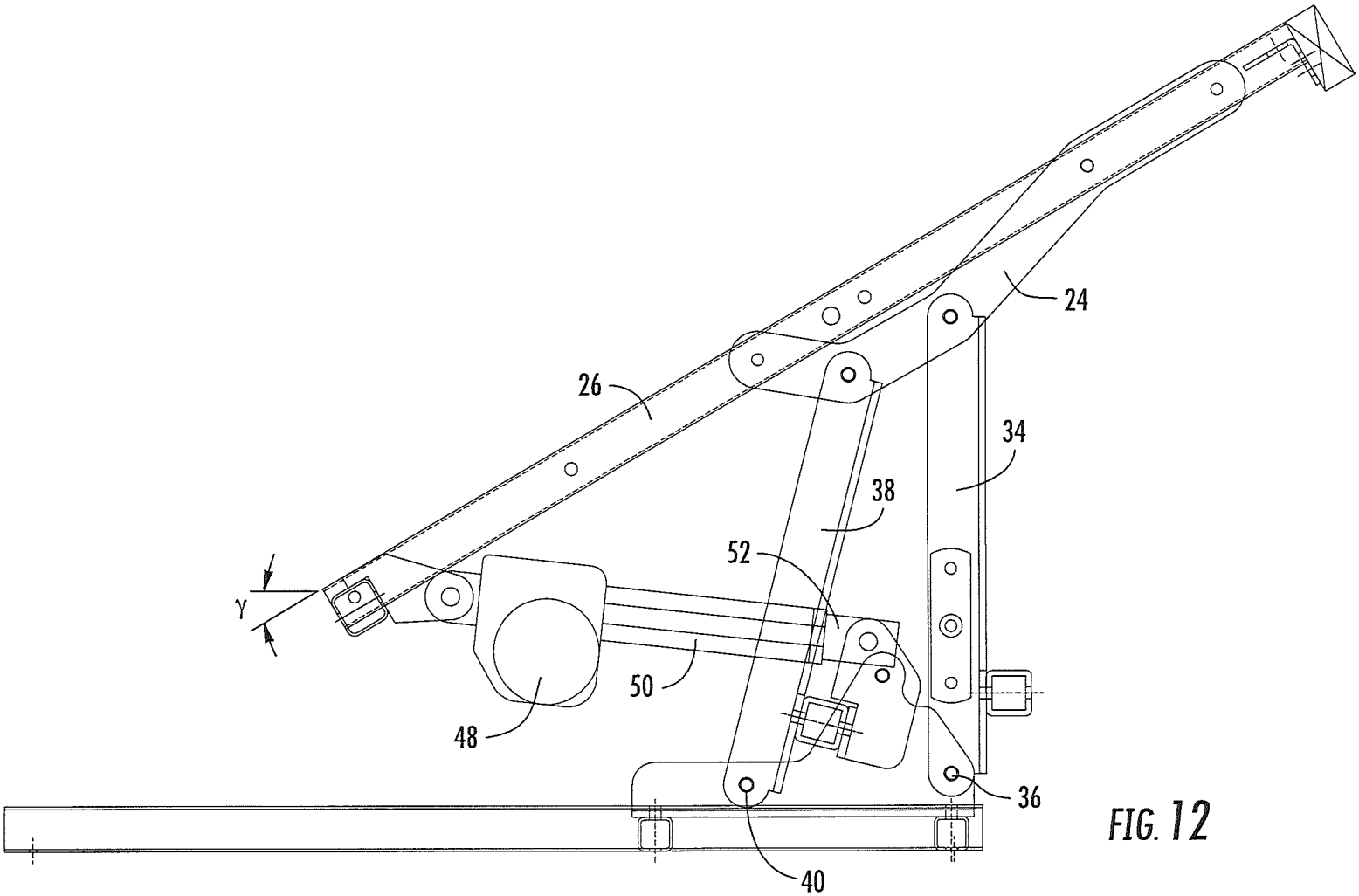
FIG. 12 is a cutaway side view of the tilt mechanism of FIG. 11, with the chair in its fully reclined position.

The chair 10 can be moved to a fully reclined position (FIGS. 3, 6, 9 and 12) by continuing to activate the motor 48 so that the rod 52 continues to retract within the sleeve 50. Continued retraction of the rod 52 draws the rear end of the seat frame 26 lower and farther forward, with such movement being controlled by the front and rear tilt links 34, 38 as they rotate further clockwise about their respective pivots 36, 40. In the fully reclined position, the front tilt link 34 is substantially vertically disposed, and the seat frame 26 defines an angle $\gamma$ of between about 28 and 32 degrees with the floor (see FIG. 12).

In addition, further retraction of the rod 52 and accompanying movement of the seat frame 26 causes further clockwise rotation of the transition link 106 about the pivot 110. This movement forces the footrest drive link 112 forward, which, via the footrest swing links 74, 78 and footrest extension links 82, 88, causes the footrest 18 to extend fully in front of the seat 19 and rotate to a substantially horizontal position.

Further, rotation of the transition link 106 draws the backrest drawing link 102 forward, which induces the backpost 98 to rotate counterclockwise about the pivot 100. In its fully reclined position, the backpost 98 defines an angle $\delta$ with the floor of between about 10 and 18 degrees (see FIG. 9).

The advent of home health care has created a need for furniture that provides functional features for the patient as well as more conventional function for others. The chair 10, which can stop at any position between the upright position of FIGS. 1, 4, 7 and 10 and the fully reclined position of FIGS. 3, 6, 9 and 12, is also capable of moving to the "heart-rest" in a similar manner as traditional, non-medical recliner chairs. As can be seen in FIGS. 3, 6, 9 and 12, the chair 10 reaches a position in which the occupant of the chair is postured such that his legs are elevated to a height equal to or above his heart, with the result that blood is encouraged to flow to the heart rather than pooling in the legs. In some embodiments, the uppermost portion of the seat 19 is between about 1 and 6 inches higher than an uppermost portion of the backrest 16. Thus, the chair 10 can serve as a health care chair in addition to providing numerous reclined positions, and can do so while configured in a number of modern furniture styles.

Those skilled in this art will appreciate that the chair may take other forms. For example, in some embodiments, the chair may have additional footrests rather than the single footrest shown herein, and the footrests may retract below the seat in a different manner. The footrest may also extend more prominently in the intermediate position shown herein.

In some embodiments, the attachment of the power actuating unit to the tilting mechanism may vary; as an example, the rod of the power actuating unit may attach to the front tilt link rather than the rear tilt link. Alternatively, the power actuating unit may be oriented such that the motor is at the front, rather than the rear.

Further, the tilting mechanism may take a different form. For example, there may be intermediate links between the front and rear tilt links and the seat. As another example, in some embodiments the adapter link may be omitted, such that the front and rear tilt links attached directly to the seat frame.

Moreover, the reclining mechanism may take a different form. Those skilled in this art will appreciate that other linkages for extending the footrest may be employed, including those that may extend the footrest more quickly in the reclining motion relative to the reclining of the backrest. Also, differently configured linkages for reclining the backrest relative to the seat may also be used.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reclining health-care chair, comprising:

a base configured to rest on an underlying surface;

a frame including a pair of opposed arms;

a seat fixed to a rigid seat frame assembly;

a backrest;

a footrest;

a tilting mechanism comprising front and rear tilt links directly pivotally attached to the base and to the seat frame assembly and forming a four-bar linkage, the tilting mechanism configured to control movement of the seat relative to the base;

a reclining mechanism comprising a plurality of pivotally interconnected links, the reclining mechanism attached to the backrest, footrest, seat, frame and tilting mechanism to control relative movement of the backrest, footrest, and frame relative to the base and the seat; and a power actuating unit attached directly to the seat and directly to at least one of the front and rear tilt links of the tilting mechanism;

wherein the chair is movable between (a) an upright position, in which the footrest is retracted beneath the seat, the seat defines an angle $\alpha$ relative to the underlying surface, and the backrest defines an angle$\epsilon$ relative to the underlying surface, and (b) a fully reclined position, in which the footrest is extended in front of the seat, the seat defines an angle $\gamma$ relative to the underlying surface that is greater than the angle $\alpha$, with a rear end of the seat lower than in the upright position, the backrest defines an angle $\delta$ relative to the underlying surface that is less than the angle $\epsilon$, and the footrest is positioned such that an occupant's feet are higher than the occupant's heart;

wherein at least one of the pivotally interconnected links is directly pivotally attached to at least one of the front and rear tilt links such that in moving from the upright position to the fully reclined position, forward rotation of the front and rear tilt links gradually increases the angle of the seat between the angle $\alpha$ and the angle $\gamma$.

2. The chair defined in claim 1, wherein the power actuating unit is a linear actuator.

3. The chair defined in claim 2, wherein the power actuating unit includes a rod and a sleeve, and wherein the rod is in a retracted position relative to the sleeve when the chair is in its fully reclined position.

4. The chair defined in claim 1, wherein the power actuating unit is coupled to the rear tilt link.

5. The chair defined in claim 1, wherein the chair has only a single footrest.

6. The chair defined in claim 5, wherein the footrest is positioned below and behind a frontmost edge of the seat when the chair is in the upright position.

7. The chair defined in claim 6, wherein the footrest faces forwardly and downwardly when the chair is in the upright position.

8. The chair defined in claim 1, wherein, in moving from the upright position to the fully reclined position, the chair moves to an intermediate position in which the footrest extends in front of the seat as the backrest substantially maintains its orientation relative to the seat such that the difference between $\alpha$ and $\epsilon$ is generally the same as in the upright position and the seat defines an angle $\beta$ relative to the underlying surface that is between about 20 and 25 degrees.

9. The chair defined in claim 1, wherein the reclining mechanism comprises a connecting link pivotally attached to the tilting mechanism, a transition link pivotally attached to the connecting link, a footrest drive link pivotally attached to the transition link, a backrest drawing link pivotally attached to the transition link and to the backrest, wherein the footrest drive link is pivotally attached to a pantographic footrest linkage that retracts and extends the footrest.

10. The chair defined in claim 1, wherein $\delta$ is between about 10 and 18 degrees, and $\gamma$ is between about 28 and 32 degrees.

11. The chair defined in claim 10, wherein $\alpha$ is between about 6 and 12 degrees, and $\epsilon$ is between about 50 and 58 degrees.

12. A reclining health-care chair, comprising:

a base configured to rest on an underlying surface;

a frame including a pair of opposed arms;

a seat fixed to a rigid seat frame assembly;

a backrest;

a footrest;

a tilting mechanism comprising front and rear tilt links directly pivotally attached to the base and to the seat frame assembly and forming a four-bar linkage, the tilting mechanism configured to control movement of the seat relative to the base;

a reclining mechanism comprising a plurality of pivotally interconnected links, the reclining mechanism attached to the backrest, footrest, seat, frame and tilting mechanism to control relative movement of the backrest, footrest, and frame and seat relative to the seat and the base; and a power actuating unit attached directly to the seat and directly to at least one of the front and rear tilt links of the tilting mechanism;

wherein the chair is movable between (a) an upright position, in which the footrest is retracted beneath the seat, the seat defines an angle $\alpha$ relative to the underlying surface, and the backrest defines an angle $\epsilon$ relative to the underlying surface, and (b) a fully reclined position, in which the footrest is extended in front of the seat, the seat defines an angle $\gamma$ relative to the underlying surface that is greater than the angle $\alpha$, with a rear end of the seat lower than in the upright position, the backrest defines an angle $\delta$ relative to the underlying surface that is less than the angle $\epsilon$, and an uppermost portion of the seat is between about 1 and 6 inches higher than an uppermost portion of the backrest;

wherein at least one of the pivotally interconnected links is directly attatched to at least one of the front and rear tilt links such that in moving from the upright position to the fully reclined position, forward rotation of the front and rear tilt links gradually increases the angle of the seat between the angle $\alpha$ and the angle $\gamma$.

13. The chair defined in claim 12, wherein $\delta$ is between about 10 and 18 degrees, and $\gamma$ is between about 28 and 32 degrees.

14. The chair defined in claim 13, wherein $\alpha$ is between about 6 and 12 degrees, and $\epsilon$ is between about 50 and 58 degrees.

15. The chair defined in claim 12, wherein the tilting mechanism is coupled to the reclining mechanism.

16. The chair defined in claim 12, wherein the reclining mechanism comprises a connecting link pivotally attached to the tilting mechanism, a transition link pivotally attached to the connecting link, a footrest drive link pivotally attached to the transition link, a backrest drawing link pivotally attached to the transition link and to the backrest, wherein the footrest drive link is pivotally attached to a pantographic footrest linkage that retracts and extends the footrest.

17. A reclining health-care chair, comprising:

a base configured to rest on an underlying surface;

a frame including a pair of opposed arms;

a seat fixed to a rigid seat frame assembly;

a backrest;

a footrest;

a tilting mechanism comprising front and rear tilt links directly pivotally attached to the base and to the seat frame assembly and forming a four-bar linkage, the tilting mechanism configured to control movement of the seat relative to the base;

a reclining mechanism coupled to the tilting mechanism and comprising a plurality of pivotally interconnected links, the reclining mechanism attached to the backrest, footrest, seat, frame and tilting mechanism to control relative movement of the backrest, footrest, and frame and seat relative to the seat and the base; and a power actuating unit attached directly to the seat and directly to at least one of the front and rear tilt links of the tilting mechanism;

wherein the chair is movable between (a) an upright position, in which the footrest is retracted beneath the seat, the seat defines an angle $\alpha$ relative to the underlying surface, and the backrest defines an angle $\epsilon$ relative to the underlying surface, and (b) a fully reclined position, in which the footrest is extended in front of the seat, the seat defines an angle $\gamma$ relative to the underlying surface that is greater than the angle $\alpha$, with a rear end of the seat lower than in the upright position, the backrest defines an angle $\delta$ relative to the underlying surface that is less than the angle $\epsilon$, and the footrest is positioned such that an occupant's feet are higher than the occupant's heart;

wherein at least one of the pivotally interconnected links is directly pivotally attached to at least one of the front and rear tilt links such that in moving from the upright position to the fully reclined position, forward rotation of the front and rear tilt links gradually increases the angle of the seat between the angle $\alpha$ and the angle $\gamma$.

* * * * *